US010276915B2

(12) United States Patent
McCoy

(10) Patent No.: US 10,276,915 B2
(45) Date of Patent: Apr. 30, 2019

(54) SCISSORS MAST FOR SUPPORTING A CELLULAR ANTENNA ON A MOBILE ASSET

(71) Applicant: Sun West Engineering, Inc., Phoeniz, AZ (US)

(72) Inventor: Phillip McCoy, Peoria, AZ (US)

(73) Assignee: Sun West Engineering, Inc., Phoenix, AZ (US)

( * ) Notice: Subject to any disclaimer, the term of this patent is extended or adjusted under 35 U.S.C. 154(b) by 292 days.

(21) Appl. No.: 15/246,180

(22) Filed: Aug. 24, 2016

(65) Prior Publication Data

US 2018/0062239 A1 Mar. 1, 2018

(51) Int. Cl.
*H01Q 1/12* (2006.01)
*H01Q 1/32* (2006.01)

(52) U.S. Cl.
CPC ..... *H01Q 1/1235* (2013.01); *H01Q 1/3216* (2013.01)

(58) Field of Classification Search
CPC ..... H01Q 1/12
USPC ..... 343/713
See application file for complete search history.

(56) References Cited

U.S. PATENT DOCUMENTS

| | | | | |
|---|---|---|---|---|
| 5,427,197 | A * | 6/1995 | Waters | B66F 11/04 182/2.9 |
| 6,041,232 | A | 3/2000 | Jennings, III | |
| 2005/0187712 | A1 | 8/2005 | Callaghan et al. | |
| 2006/0028390 | A1 | 2/2006 | Norwood | |
| 2012/0139786 | A1 | 6/2012 | Puzella et al. | |
| 2015/0288060 | A1* | 10/2015 | Corliss | H01Q 1/1235 343/848 |

OTHER PUBLICATIONS http://www.matsing.com.
Scissor Lifts vs. Boom Lifts. Datasheet [online]. Coast to Coast Equipment, Jul. 18, 2015. http://www.c2cequip.com/scissor-lifts-vs-boom-lifts.
International Search Report, PCT/US17/48489 dated Nov. 8, 2018; 3pgs.
Written Opinion, PCT/US17/48489 dated Nov. 8, 2018; 5pgs.

* cited by examiner

*Primary Examiner* — Andrea Lindgren Baltzell
(74) *Attorney, Agent, or Firm* — Jennings, Strouss & Salmon PLC; Michael K. Kelly; Daniel R. Pote

(57) ABSTRACT

A self-contained, mobile cellular system mounted on a vehicle bed. The system includes: an extendable scissors mast having a plurality of sections, each section comprising a first cross bar pivotably connected to a second cross bar, the mast further including an actuator configured to selectively extend and retract the mast; and an antenna fixed atop the mast.

20 Claims, 14 Drawing Sheets

SCISSORS MAST FOR SUPPORTING A CELLULAR ANTENNA ON A MOBILE ASSET

TECHNICAL FIELD

The present invention relates, generally, to extendable masts for temporary cellular towers and, more particularly, to a vehicle-mounted scissor mast for supporting an antenna.

BACKGROUND

Temporary cellular towers are often used during disaster recovery, golf tournaments, concerts, conventions, and other event driven spikes in usage which could otherwise overwhelm existing telecommunications infrastructure, which typically includes linked cell towers communicating with a central switch. Each cell tower includes an antenna for transmitting and receiving signals from handheld devices, a microwave panel for communicating bundled data to and from the switch, radio equipment and associated electronics, an AC/DC rectifier for supplying DC power to the various components, and a fixed mast for suspending the antenna and microwave panel above ground. Accordingly, temporary, vehicle mounted cell phone towers typically require some version of these same components in order to seamlessly integrate into existing network infrastructure.

Temporary cell towers are typically trailer or truck mounted, and include the same hardware and functionality as a permanent cell tower, namely, an antenna, an extendable/retractable mast for supporting the antenna at a desired elevation, radios, a microwave panel, equipment cabinets mounted on the truck bed or trailer, and a power generator and/or rectifier.

Presently known multi-bean base station antennae from Matsing RF Lens Technologies of Irving, Calif. antennae exhibit greatly enhanced capacity over previous generation antennae, and comprise a large ball or substantially spherical shape. (See, http://www.matsing.com/, the entire contents of which are hereby incorporated by this reference). This can be problematic for permanent installations due to zoning, real estate, and other restrictions which do not necessarily apply to vehicular cell tower installations.

Presently known techniques for installing a temporary cellular tower supporting a high capacity antenna typically require one truck for the operational mobile station, another truck to haul the antenna, a third truck to carry the crane used to hoist the antenna onto the mast, and perhaps a fourth truck to transport a man-bucket used by personnel to attach the antenna to the extended mast. This is a cumbersome and costly procedure. Presently known masting techniques employ 400-800 pound capacity hydraulic or pneumatic masts which, in their retracted position, remain within the 162 inch (13' 6") practical limit during transport. The masts are then extended up to the 40 or 60 feet height required at the site. These masts typically comprise nested (telescoped) tubes, and are thus limited in their ability to support newer, heavier antennae. In particular, prior art telescoped masts do not provide sufficient support for emerging antennas which weigh in the range of 1,000 pounds or more.

Systems and methods are thus needed which overcome the limitations of the prior art.

Various features and characteristics will also become apparent from the subsequent detailed description and the appended claims, taken in conjunction with the accompanying drawings and this background section.

BRIEF SUMMARY

The present invention provides an extendable mast for use on a mobile cell tower platform, the mast being configured in the form of scissors or other foldable members. By mounting the antenna to a scissors mast, the antenna can be carried to the site on the same truck which carries the mast and hoisted in situ, eliminating the need for multiple vehicles and crews. This substantially reduces the time and cost associated with installation.

It should be noted that the various inventions described herein, while illustrated in the context of Matsing's 12 beam antenna, are not so limited. Those skilled in the art will appreciate that the inventions described herein may contemplate antennae of any size and capacity.

Various other embodiments, aspects, and features are described in greater detail below.

BRIEF DESCRIPTION OF THE DRAWING FIGURES

Exemplary embodiments will hereinafter be described in conjunction with the appended drawing figures, wherein like numerals denote like elements, and:

DETAILED DESCRIPTION OF PREFERRED EXEMPLARY EMBODIMENTS

Figure 1:
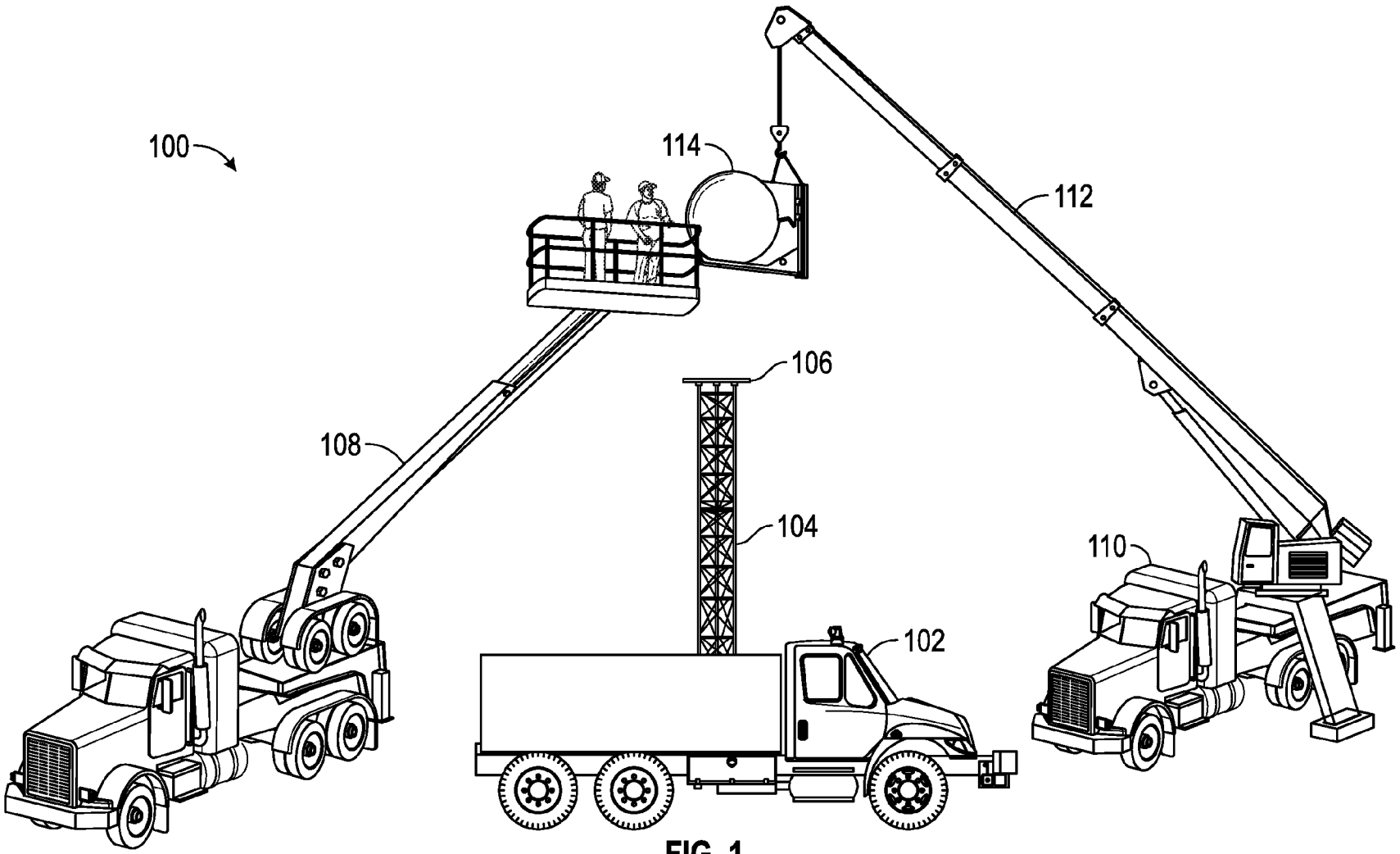
FIG. 1 (Prior Art)
FIG. 1 illustrates a system for hoisting an antenna atop a temporary cell tower involving a vehicle-mounted telescopic mast platform, a vehicle-mounted man bucket, a vehicle-mounted crane, and a transport vehicle for transporting the antenna to the installation site according to the prior art.

The following detailed description of the invention is merely exemplary in nature and is not intended to limit the invention or the application and uses of the invention. Furthermore, there is no intention to be bound by any theory presented in the preceding background or the following detailed description.

Various embodiments of the present invention relate to systems and methods for a truck or trailer mounted mobile cell tower system including: i) an antenna for communicating with a plurality of wireless devices; ii) a microwave panel or fiber optic cable for communicating with a switch; iii) radio equipment; iv) a generator and an AC/DC rectifier for supplying DC power to the foregoing; v) refrigeration; and vi) associated electronics. In this way the mobile cell tower can travel to the installation site and seamlessly integrate into the existing network infrastructure.

In accordance with one aspect of the invention, a vehicle (e.g., truck, trailer) includes an extendable mast assembly configured to support an antenna during travel to the installation site such that, in the retracted position, the total height of the mast and antenna is less than a typical bridge height limit (e.g., 13 feet or, alternatively, 13 feet, 6 inches). The mast assembly is further configured to extend and thereby hoist the antenna to an operating height (e.g., up to 40 to 60 feet above ground) without having to remove the antenna from the mast during travel to the site or during mast extension.

In this way, the mast, antenna, and ancillary equipment (refrigerated radio cabinets, generator, AC/DC converter, and associated electronics) may be contained on a single vehicle within a volume of space suitable for travel on public roads, without the need for an additional vehicle to transport a crane, man buckets, and the like as previously required in prior art systems. By arranging the antenna and extendable mast assembly on a single, self-contained truck bed, the cost to deploy a temporary cell tower in the field is greatly reduced. The present invention accomplishes this by configuring the extendable mast assembly within predetermined height, length, and width dimensions, while providing sufficient structure (e.g., including wire guys) to support the antenna in the extended position even in the presence of wind loading.

In a preferred embodiment, a sectional mast assembly is employed, for example, in the form of a scissors, folding arms, or other collapsible structure. An air compressor, hydraulic system, or other mechanical actuator may be used to extend and retract the mast.

According to a further aspect of the present invention, an extendable antenna mast assembly supports the antenna atop the mast while transporting the antenna to the installation site, while maintaining a combined stacked height less than the maximum recommended bridge/overpass clearance height, for example either 13 feet or 13 feet 6 inches from the ground. For a truck bed having a top surface located 36 inches above the ground, the combined stacked height of the mast assembly and the antenna must fit within an approximately 120 inch height profile to stay within a 156 inch total height limit; alternatively, the mast assembly and antenna must fit within a 126 inch height profile to stay within a 162 inch height limit.

For an antenna having a height dimension in the range of 80 inches, the retracted mast assembly preferably exhibits a height dimension in the range of 40 to 46 inches. The present inventor has determined that a 40 to 46 inch tall retracted mast assembly may be extended to hoist the antenna up to a height range of 40 to 60 feet using a scissors (or other foldable) configuration, as described in greater detail below.

Viewed from another perspective, the challenge in using a scissors-type masting system to hoist a ball (or other) antenna may be characterized as follows: i) placing the extendable mast and the stacked antenna in an envelope defined by a width parameter (typically about 96-102 inches) and a height parameter (typically about 110-117 inches above a truck bed) of a road worthy vehicle; ii) extending the mast at the end user site to position the top of the antenna at a height in the range of 492 inches above the ground; and iii) maintaining sufficient structural integrity (typically using guy wires) to withstand wind loading on a spherical antenna having a diameter in the range of 80 inches and a gross weight in the range of 800 to 1500 pounds, and preferably about 1,00 to 1,200 pounds.

While scissor lifts are generally well known, they typically exhibit a maximum extension in the range of 32 feet, which corresponds to the maximum reach height of typical industrial building ceilings. Moreover, while many scissor lifts are also mobile, it would be counter-intuitive to permanently mount a scissor lift on a truck bed. Notwithstanding the apparent dissonance associated with a truck mounted scissor lift, the present inventor has solved a long felt need in the cell tower industry by integrating a scissor structure with a portable cell tower system in the manner described herein.

To provide additional structural support for the hoisted antenna, the vehicle mounted mobile cell tower system includes a guy wire system for anchoring the antenna to the vehicle, to the ground, or both. Further embodiments contemplate the ability to rotate, for example to facilitate pointing, the antenna to follow the crowd or otherwise track the location of bandwidth density as it changes over time.

Referring now to FIG. 1, a prior art system 100 for hoisting an antenna 114 atop a temporary cell tower 104 includes a self-contained mobile cell tower system 102 having a telescopic mast 102 and a platform 106 for supporting the antenna, a vehicle-mounted man bucket 108 to facilitate the field installation of the antenna onto the mast platform, a vehicle 110 having a crane 112 for hoisting the antenna, and a transport vehicle (not shown) for transporting the antenna to the installation site.

Figure 2:
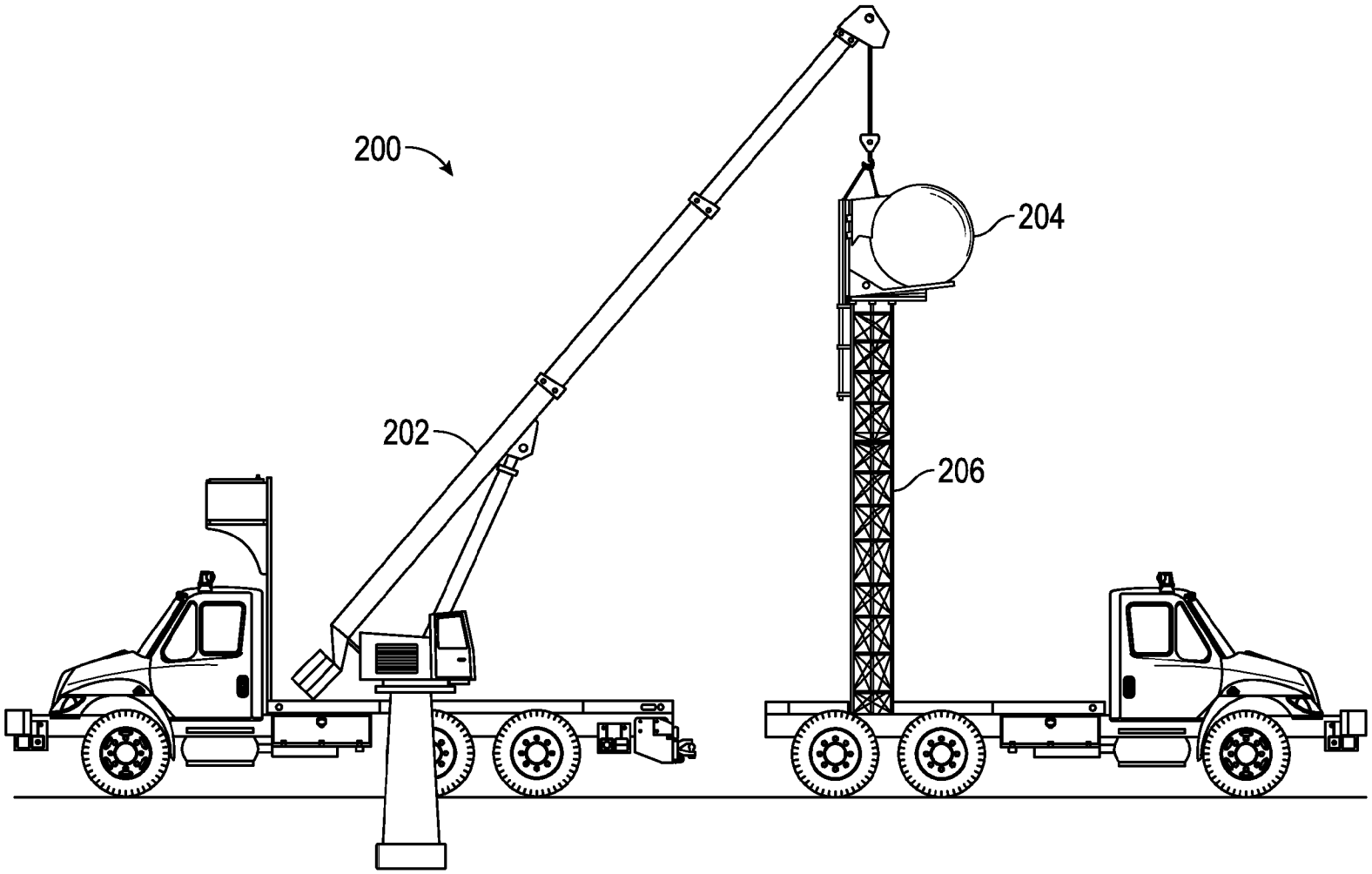
FIG. 2 (Prior Art)
FIG. 2 illustrates an antenna being placed onto a lattice-type mast according to the prior art.

FIG. 2 is depicts an alternative prior art system 200 showing a crane 202 hoisting an antenna 204 atop a lattice-type mast.

Figure 3:
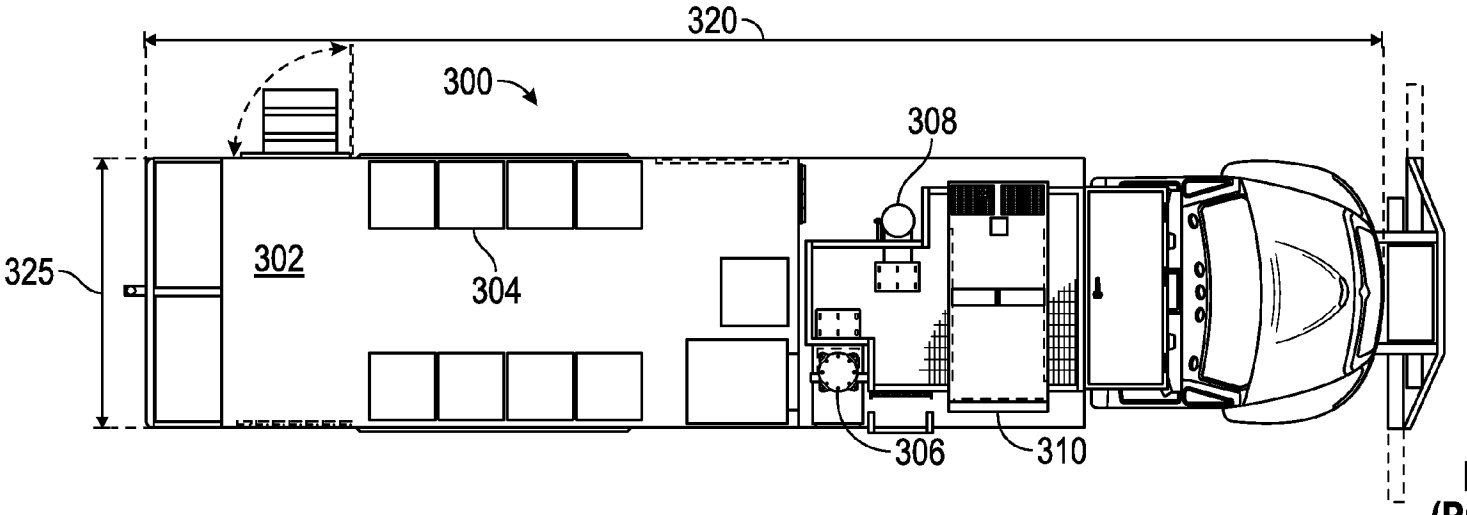
FIG. 3 (Prior Art)
FIG. 3 is a schematic top plan view of an exemplary self-contained vehicular cell tower according to the prior art.

FIG. 3 is an exemplary self-contained cell tower vehicle 300 according to the prior art. The vehicle includes a cabinet bay enclosure 302 for storing radio equipment and other electronics 304, a first extendable mast 306, a second extendable mast 308, and a generator 310. To qualify as road worthy, on public thoroughfares, the self-contained cell tower vehicle preferably exhibits a total length dimension 320 less than or equal to 40 feet (480 inches), and a width dimension 325 less than or equal to the maximum allowed width, for example in the range of 96 to 102 inches.

Figure 4:
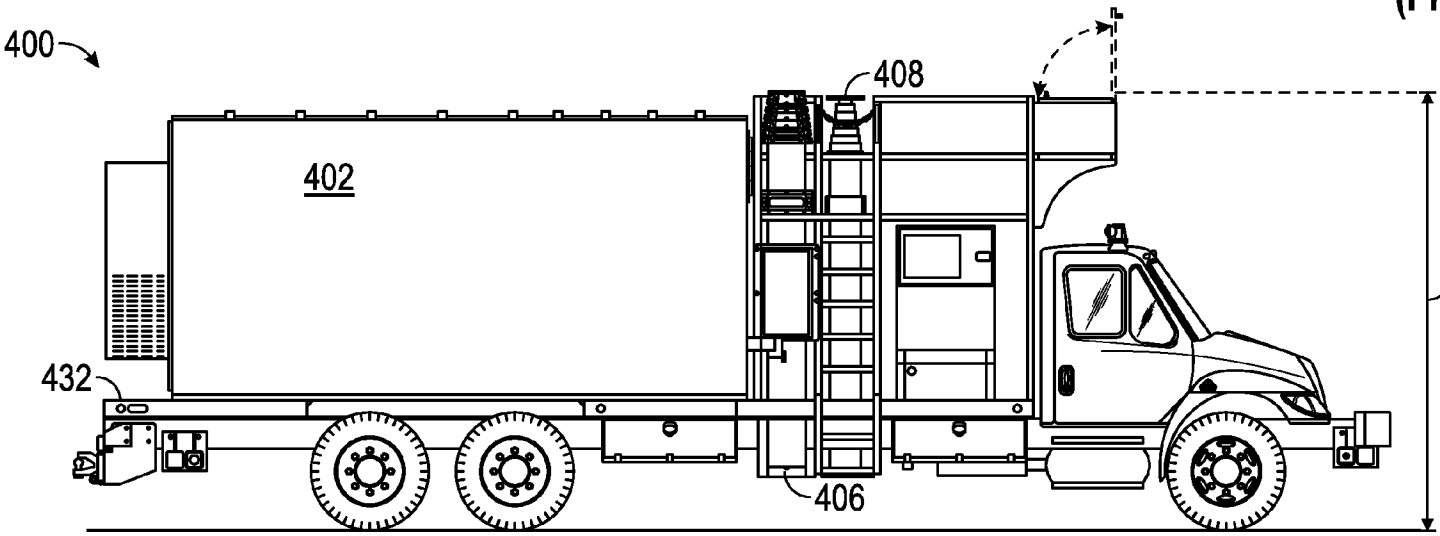
FIG. 4 (Prior Art)
FIG. 4 is a schematic side elevation view of the vehicular cell tower of FIG. 3 depicting telescoped masts in their retracted position according to the prior art.

FIG. 4 is schematic side elevation view of a vehicular cell tower 400 including a cabinet bay 402, a first telescoped mast 406, a second telescoped mast 408, and a truck bed top surface 432 in the range of 42 inches above the ground. As such, the retracted masts must remain within the maximum height limit 434, for example in the range of 156 to 162 inches.

Figure 5:
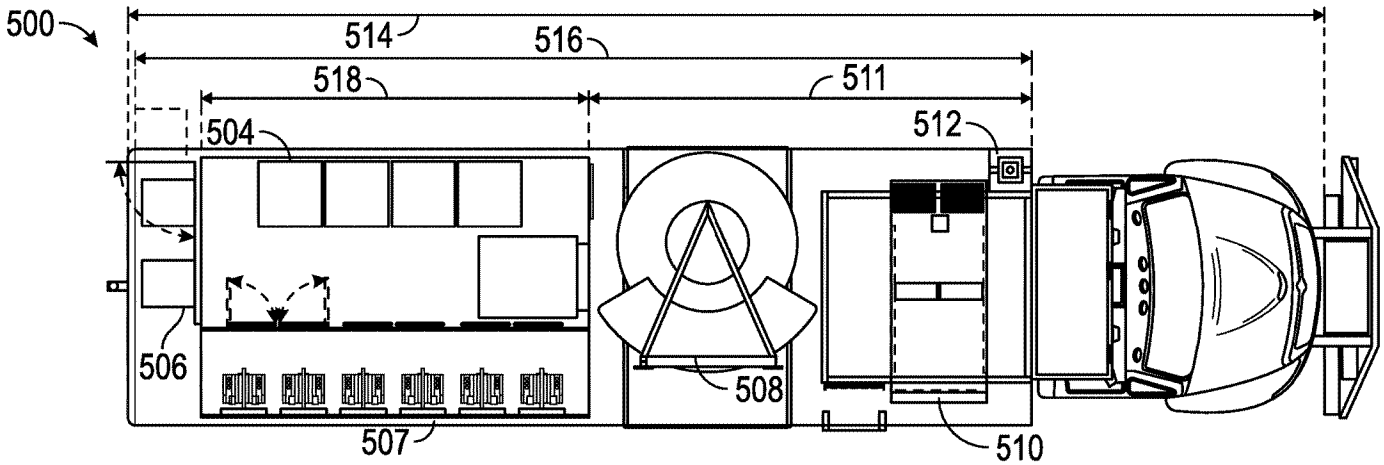
FIG. 5 is a schematic top plan view of an exemplary self-contained vehicular cell tower in accordance with various embodiments of the present invention.

FIG. 5 is an exemplary self-contained vehicular cell tower system 500 in accordance with the present invention. In the illustrated embodiment, the system 500 includes a region 502 for housing radio equipment and associated electronics 504, and one or more air conditioners 506 for cooling the equipment. The system further includes a masting antenna system 508, a power supply (e.g., generator and/or rectifier) 510, and a supplemental (e.g., telescopic) mast 512 which may include a man bucket (a/k/a crow's nest).

In an embodiment, the system 500 comprises a length dimension 514 including the truck bed and cab in the range of 400 to 480 inches, and preferably about 445 inches, a truck bed length dimension 516 in the range of 200 to 400 inches, and preferably about 336 inches, a cabinet bay dimension 518 in the range of 100 to 200 inches, and preferably about 145 inches, and a mast platform length dimension 511.

Figure 6:
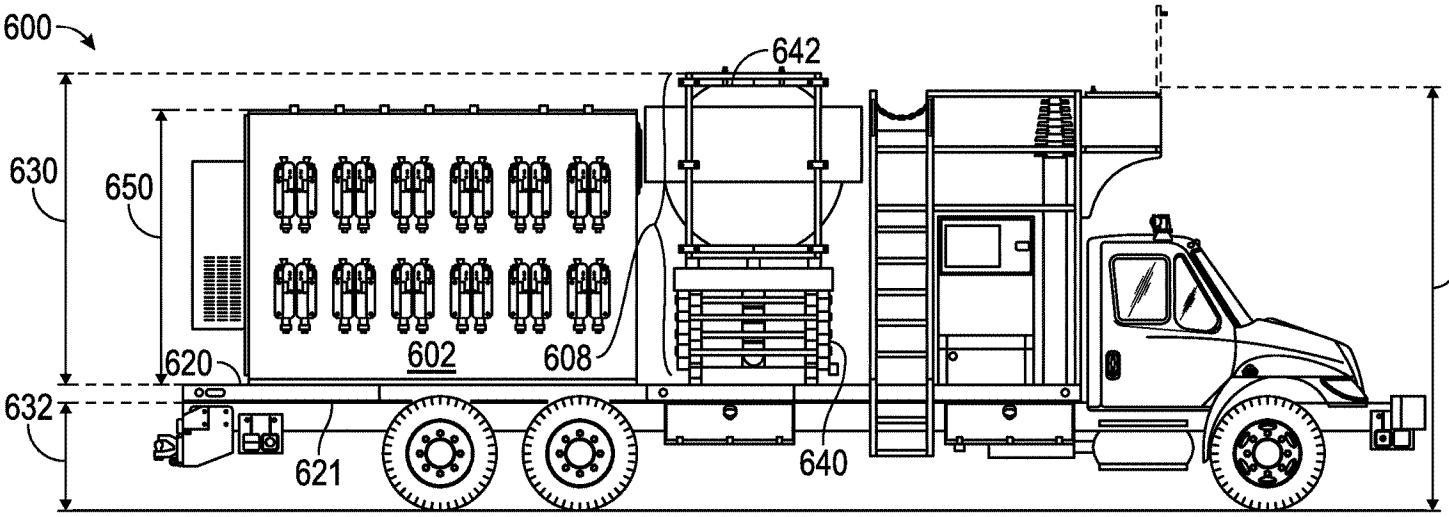
FIG. 6 is a schematic side elevation view of the vehicular cell tower of FIG. 5 depicting a scissor mast in the retracted position supporting a ball antenna in accordance with various embodiments of the present invention.

FIG. 6 is a side elevation of a vehicular cell tower 600 including an electronics bay 602 and a stacked antenna and mast assembly 608 comprising an extendable mast 640 and an antenna 642. In the retracted position shown, the top of the antenna/mast assembly 608 is disposed at a distance 650 in the range of 80 to 130 inches, and preferably about 117 inches, above the truck bed top surface 620; the top of the antenna/mast assembly 608 is disposed at a distance 634 in the range of 140 to 162 inches, and preferably about 156 to 162 inches, above the ground. In similar fashion, the top of the electronics bay 602 is disposed at a distance 630, for example in the range of 80 to 117 inches, and preferably about 101 inches, above the truck bed surface 620. As shown, a bottom surface 621 of the truck bed is disposed a distance 632 above the ground, for example in the range of 24 70 57 inches, and preferably about 39 inches.

Figure 7:
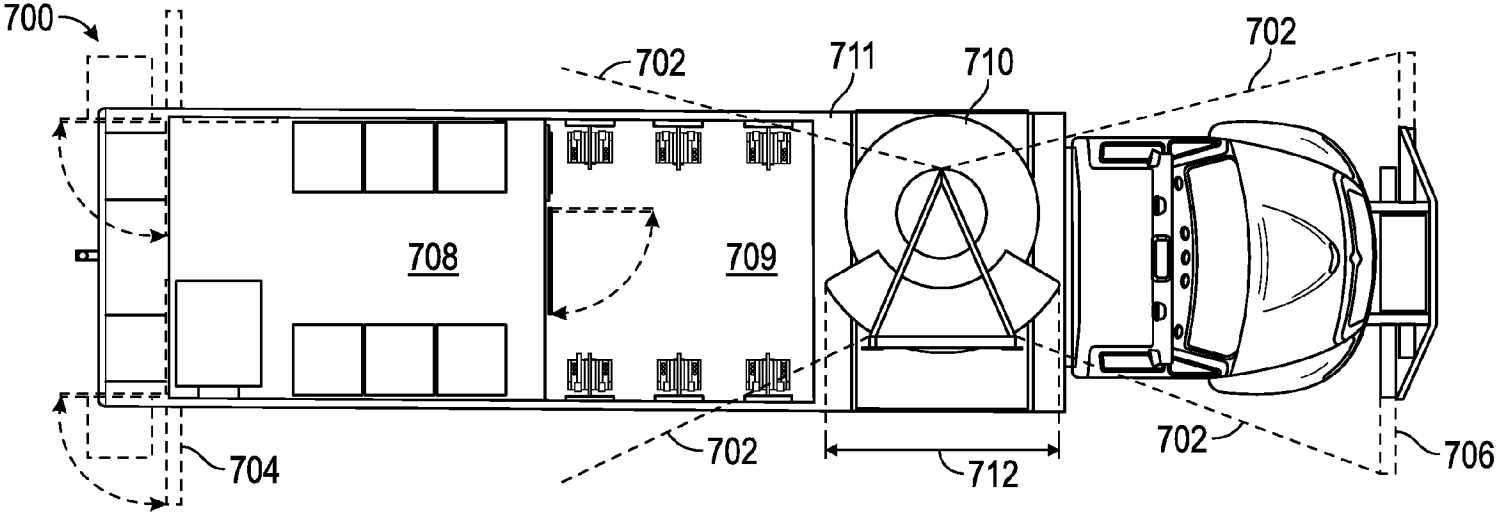
FIG. 7 is a schematic top plan view of an alternate embodiment of an exemplary self-contained vehicular mobile cell tower including a guy wire outrigger assembly according to the present invention.

FIG. 7 is an alternate embodiment of an exemplary self-contained vehicular mobile cell tower system 700 including a guy wire assembly according to the present invention. In particular, the guy wire assembly includes a plurality of guys 702 connected to an antenna/mast assembly 710 at one end, and secured to respective outriggers 704, 706 at the other end, as described below. in the illustrated embodiment, the system 700 includes a miscellaneous equipment bay 708, a radio bay 709, and a mast platform 711 having a length dimension 712 in the range of 60 to 100 inches, and preferably about 81 inches. The outriggers 704, 706 may each comprise respective slidable bumper extensions.

Figure 8:
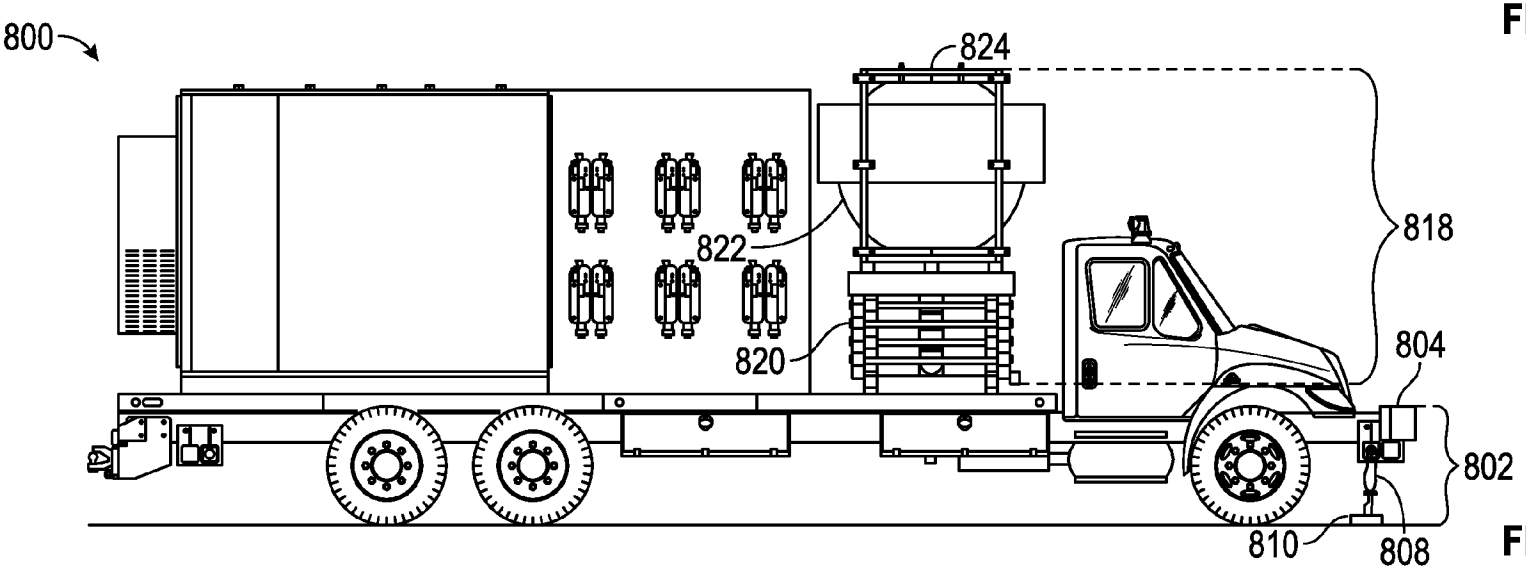
FIG. 8 is a schematic side elevation view of the vehicular cell tower of FIG. 7.

Referring now to FIG. 8, an exemplary vehicular cell tower system 800 includes an jack assembly 802 for securing an extended outrigger portion 804, comprising an adjustable jack 808 and a foot platform 810. In the illustrated embodiment, the system 800 includes a stacked antenna/mast assembly 818 including a foldable mast 820, a ball antenna 822, and a support bracket 824.

Figure 9:
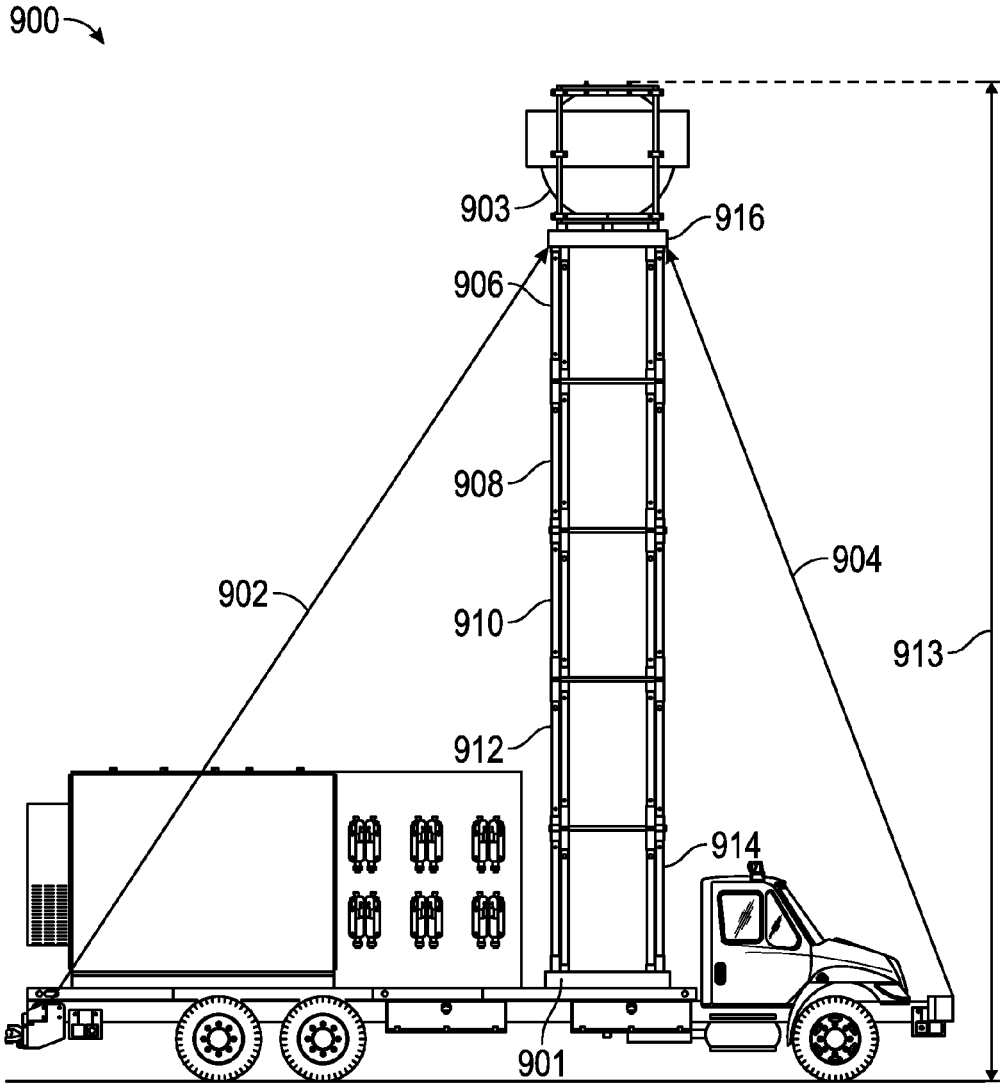
FIG. 9 is a schematic side elevation view of an exemplary vehicular cell tower depicting a scissor mast in the extended position supporting a ball antenna including an exemplary guy wire assembly in accordance with various embodiments of the present invention.

FIG. 9 is a schematic side elevation view of an exemplary vehicular cell tower 900 depicting a scissor mast 901 in the extended position supporting an antenna 903. A guy wire system includes one or more rear guys 902 and one or more from guys 904 to stabilize the antenna and mast, particularly in the presence of wind. In the illustrated embodiment, the top of the antenna is extended to a dimension 913 in the range of 250 to 800 inches, and preferably about 492 to 720 inches above ground. The mast 901 includes a plurality of independently extendable sections 906, 914, terminating at an upper platform 916 which supports the antenna 903.

Figure 10:
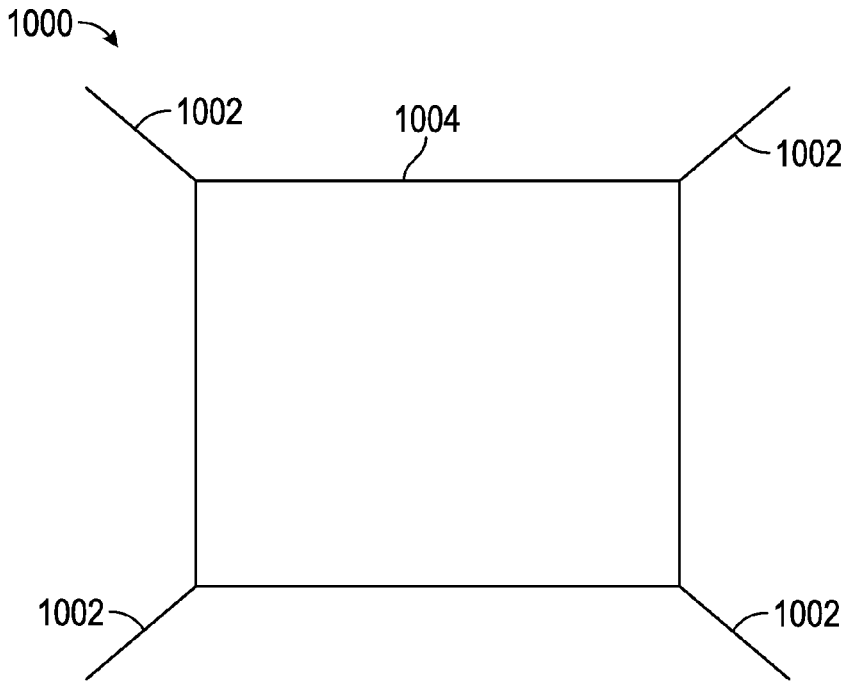
FIG. 10 is a schematic top plan view of a guy wire mounting assembly for the extended scissor mast shown in FIG. 9 in accordance with various embodiments of the present invention.

FIG. 10 is a schematic top plan view of a guy wire mounting assembly 1000 including guys 1002 connected to a mast platform 1004.

Figure 11:
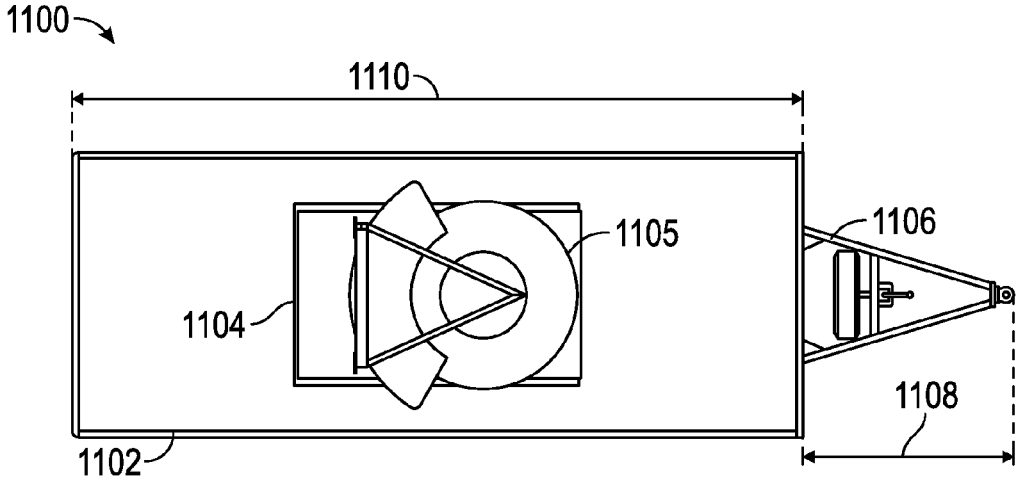
FIG. 11 is a schematic top plan view of a trailer mounted scissor mast supporting a ball antenna in accordance with various embodiments.

FIG. 11 is an alternative embodiment of a mobile cell tower system 1100 including a trailer bed 1102 and a towing bar 1106. A folding mast assembly 1104 supports a ball antenna 1105. The trailer bed 1102 has a length dimension 1110 in the range of 200 to 400 inches, and preferably about 264 inches; the tow bar 1106 exhibits a length dimension 1108 in the range of 48 to 110 inches, and preferably about 72 inches.

Figure 12:
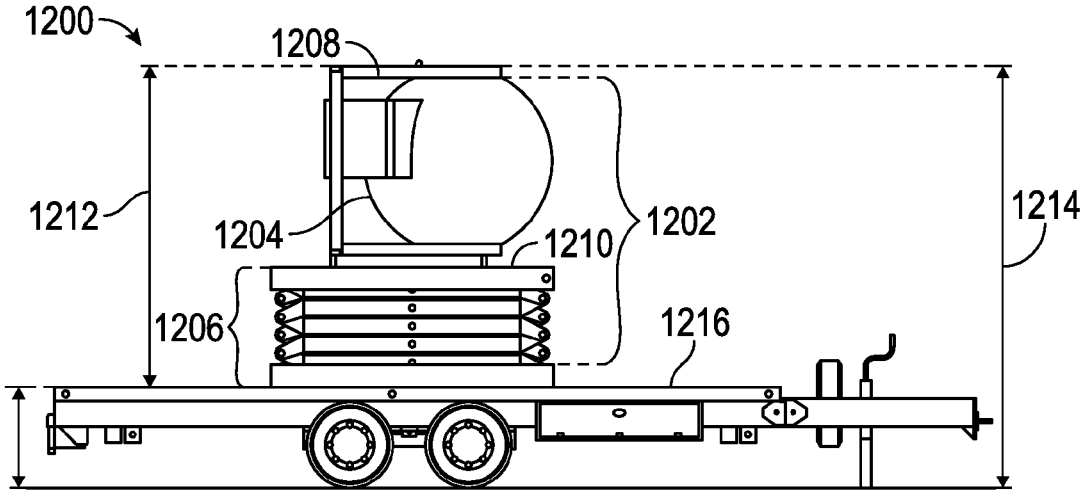
FIG. 12 is a schematic side elevation view of the stacked scissor mast and ball antenna of FIG. 11 shown in the retracted position in accordance with various embodiments.

FIG. 12 is an exemplary mobile cell tower 1200 including stacked mast/antenna assembly 1202 comprising a ball antenna 1204, a folding (e.g., scissors) mast 1206, and a bracket structure 1208 for securing the antenna to a mast platform 1210. In accordance with one aspect of the invention, the mast/antenna assembly 1202 is configured to fit within a height dimension 1212 above a trailer bed top surface 1216 in the range of 100 to 124 inches, and preferably about 115 inches. In this way the top of the mast/antenna assembly 1202 remains within a height dimension 1214 above the ground, for example in the range of 148 to 162 inches, and preferably about 153 inches.

Figure 13:
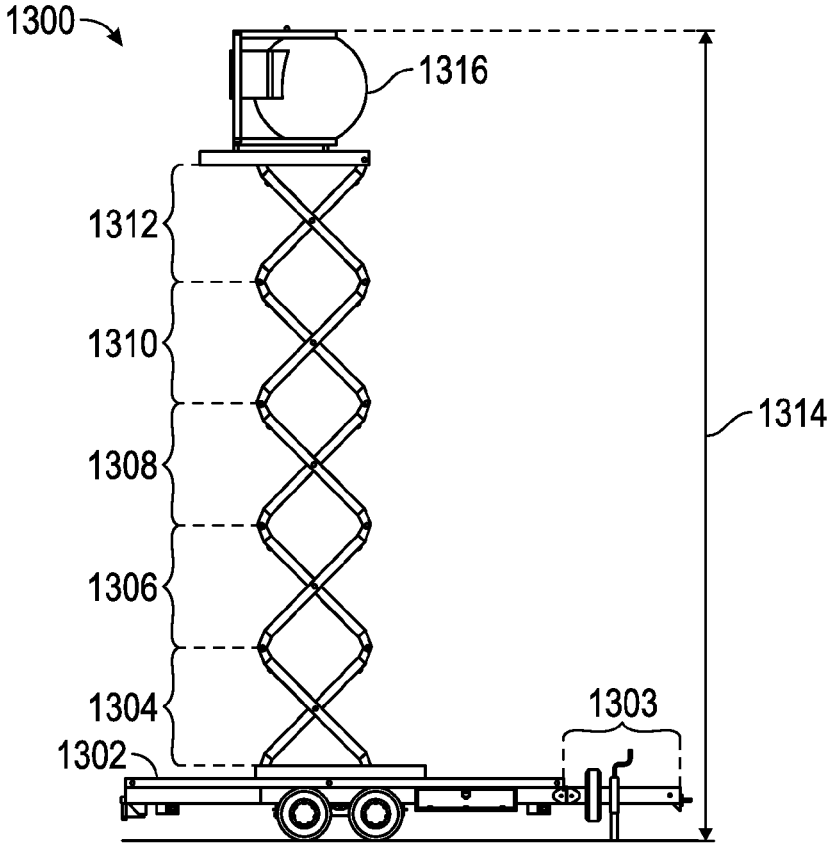
FIG. 13 is a schematic side elevation view of the stacked scissor mast and ball antenna of FIG. 12 shown in the extended position in accordance with various embodiments.

FIG. 13 is a schematic side elevation view of the stacked scissor mast and ball antenna of FIG. 12 shown in the extended position in accordance with various embodiments. In particular, FIG. 13 depicts a mobile system 1300 including a trailer bed 1302, a tow bar 1303, and extended scissor mast sections 1304-1312 supporting an antenna 1316 a distance 1314 above the ground. In various embodiments the number of sections may range from two to twelve, and the distance 1314 may range from 100 to 720 inches, and preferably about 483 inches.

Figure 14:
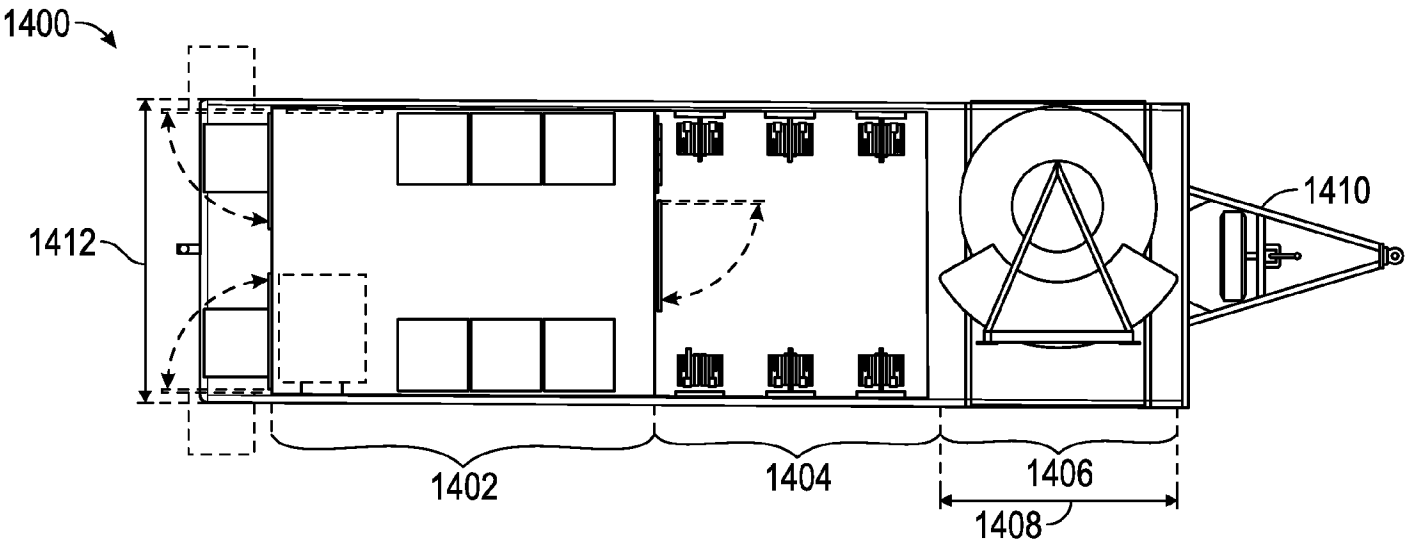
FIG. 14 is a schematic top plan view of an alternative embodiment of a trailer mounted scissor mast supporting a ball antenna according to the present invention.

FIG. 14 is an alternative embodiment of a trailer mounted cell tower system 1400 including a radio equipment bay 1404, a miscellaneous electronics bay 1402, an antenna/mast assembly 1406, and a tow bar 1410. The antenna/mast assembly 1406 suitably exhibits a length dimension 1408 in the range of 72 to 96 inches, and preferably about 81 inches, and a width dimension 1412 in the range of 80 to 120 inches, and preferably about 101 inches.

Figure 15:
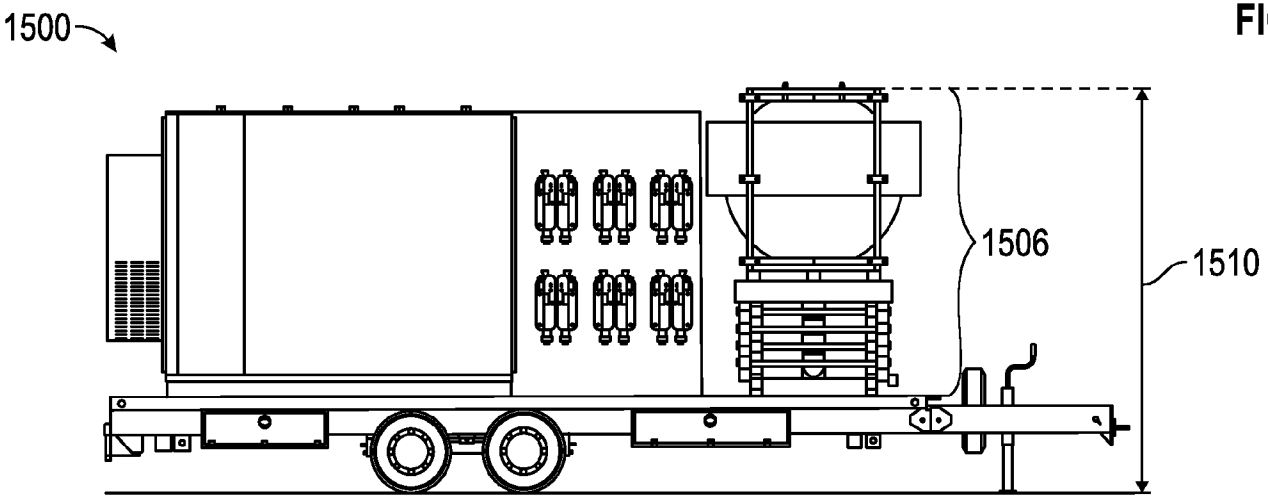
FIG. 15 is a schematic side elevation view of the stacked scissor mast and ball antenna of FIG. 14 shown in the retracted position in accordance with various embodiments.

FIG. 15 is a schematic side elevation view of the stacked scissor mast and ball antenna of FIG. 14 shown in the retracted position in accordance with various embodiments. in particular, a mobile cell tower system 1500 includes a stacked antenna/mast assembly 1506 which, in the retracted position, exhibits a height dimension 1510 above the ground in the range of 120 to 162 inches, and preferably about 153 inches.

Figure 16:
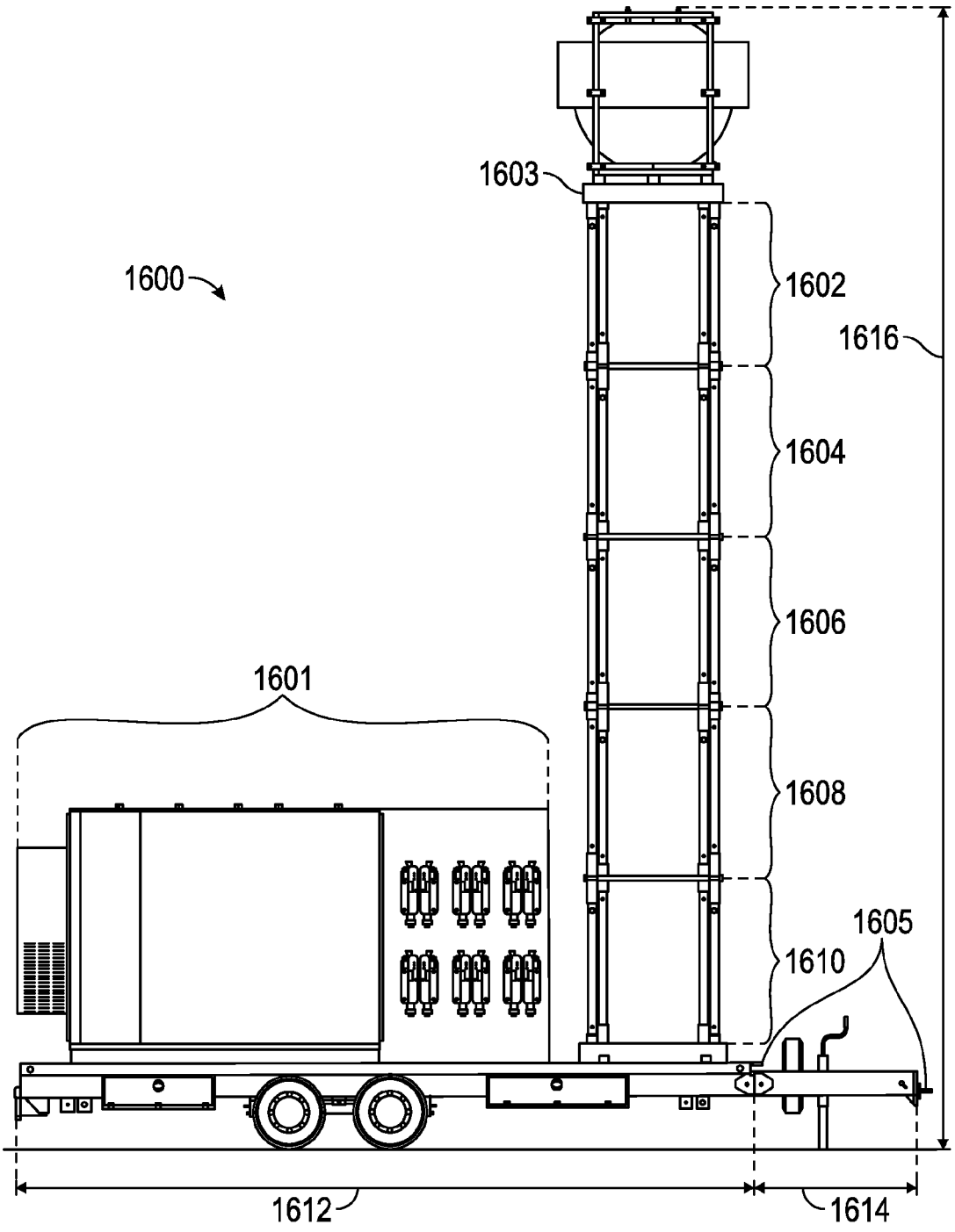
FIG. 16 is a schematic side elevation view of the stacked scissor mast and ball antenna of FIG. 15 shown in the extended position in accordance with various embodiments.

FIG. 16 is a schematic side elevation view of the stacked scissor mast and ball antenna of FIG. 15 shown in the extended position in accordance with various embodiments. in particular, a mobile tower system 1600 includes a cargo portion 1601 (which may include an air conditioner), a mast/antenna assembly 1603, and a tow bar 1605. The cargo portion 1601 and mast/antenna assembly 1603 occupy a length dimension 1612 in the range of 240 to 408 inches, and preferably about 312 inches; the tow bar 1605 exhibits a length dimension 1614 in the range of 6 to 84 inches, and preferably about 68 to 72 inches. In the partially or fully extended position, the foldable mast comprises a plurality of scissor sections 1602-1610 exhibiting a height dimension 1616 above the ground in the range of 240 to 720 inches or more, and preferably about 483 inches.

Figure 17:
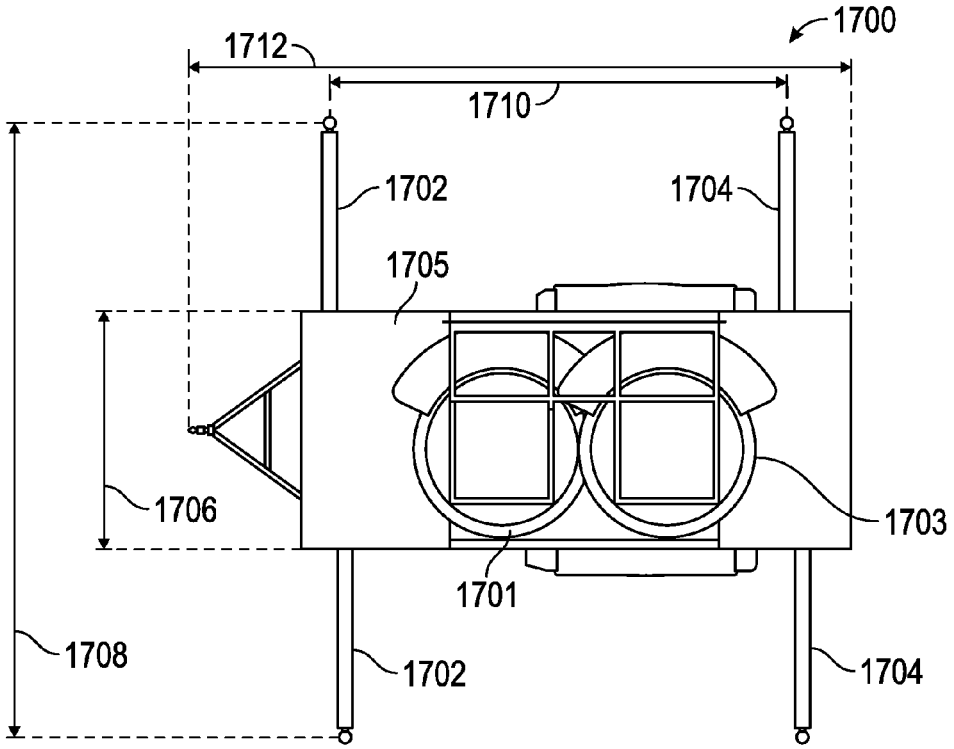
FIG. 17 is a schematic top plan view of a further alternative embodiment of a trailer mounted scissor mast supporting two antennae including front and rear outriggers according to the present invention.

FIG. 17 is a further alternative embodiment of a trailer mounted tower system 1700 including first and second array antennae 1701, 1703, front outriggers 1702, and rear outriggers 1704. The outriggers 1702, 1704 may be extended to support guy wires attached to the antennae (and/or the supporting mast) to a width dimension 1708 in the range of 100 to 480 inches, and preferably about 246 inches. The front outriggers may be spaced apart from the rear outriggers 1704 by a dimension 1710 in the range of 120 to 480 inches, and preferably about 184.5 inches. The trailer bed 1705 suitable exhibits a width dimension 1706 in the range of 96 inches.

Figure 18:
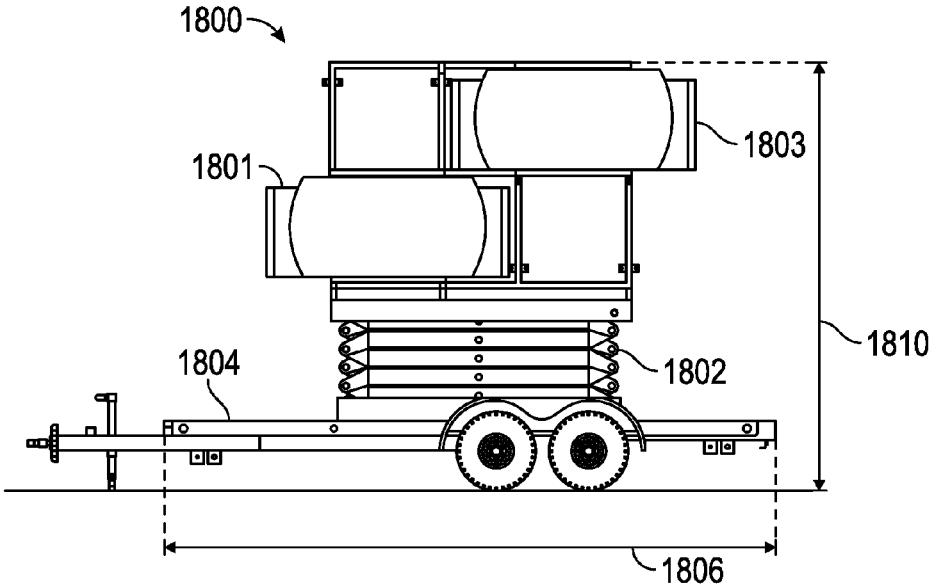
FIG. 18 is a schematic side elevation view of the stacked scissor mast and ball antennae of FIG. 17 shown in the retracted position in accordance with various embodiments.

FIG. 18 is a schematic side elevation view of the stacked scissor mast and ball antennae system of FIG. 17 shown in the retracted position in accordance with various embodiments. In particular, first and second antennae 1801, 1803 are supported by an extendable scissor mast 1802 mounted to a trailer bed 1804, such that the top of antenna 1803 exhibits a height dimension 1810 above the ground in the range of 156 or 162 inches.

Figure 19:
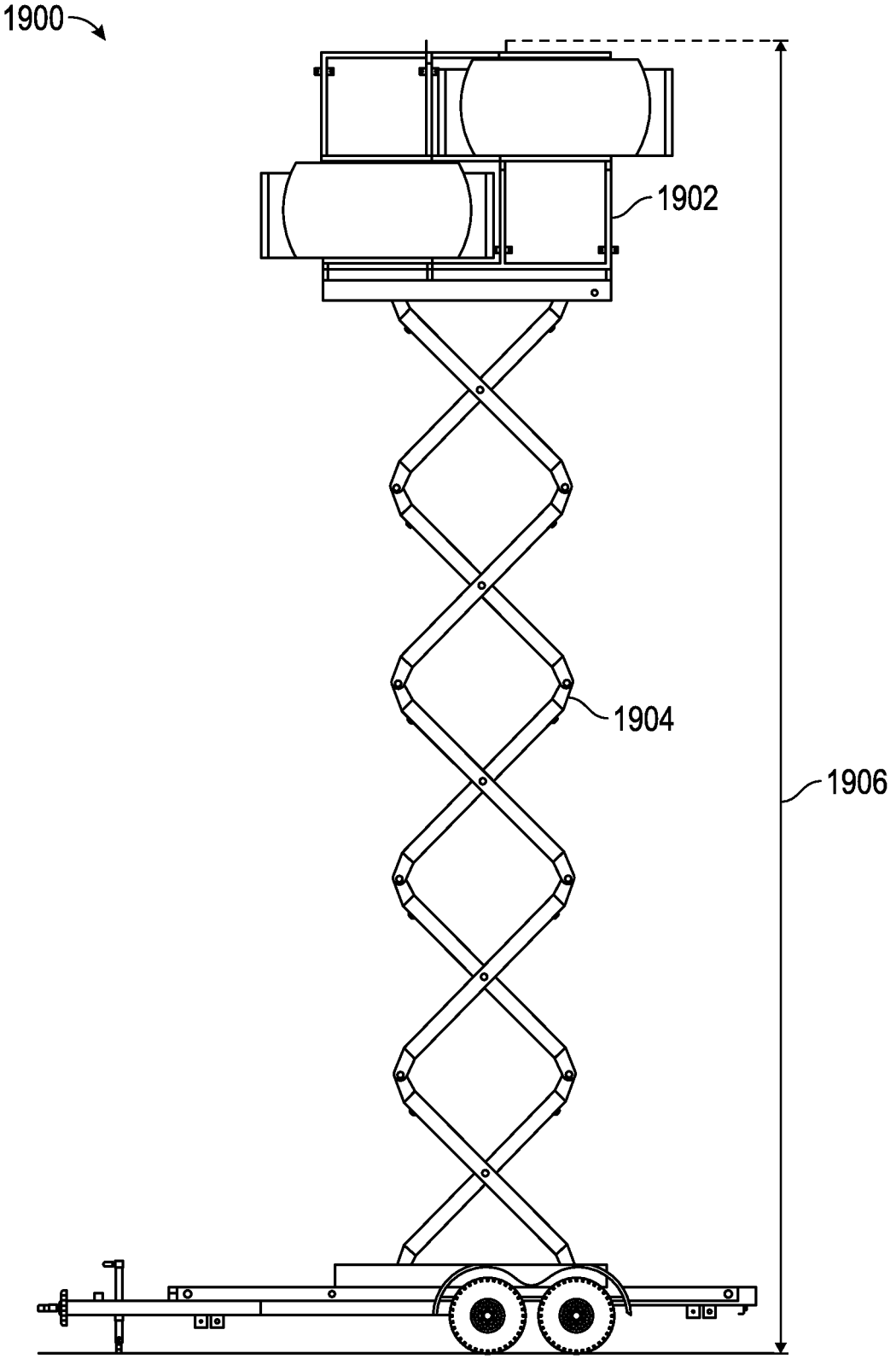
FIG. 19 is a schematic side elevation view of the stacked scissor mast and ball antenna of FIG. 18 shown in the extended position in accordance with various embodiments.

FIG. 19 is a schematic side elevation view of the stacked scissor mast and ball antenna of FIG. 18 shown in the extended position. More particularly, a mobile antenna system 1900 includes one or more antennae 1902 and a foldable mast 1904 configured to extend to a height dimension 1906 in the range of 440 to 720 inches, and preferably about 486 inches.

Figure 20:
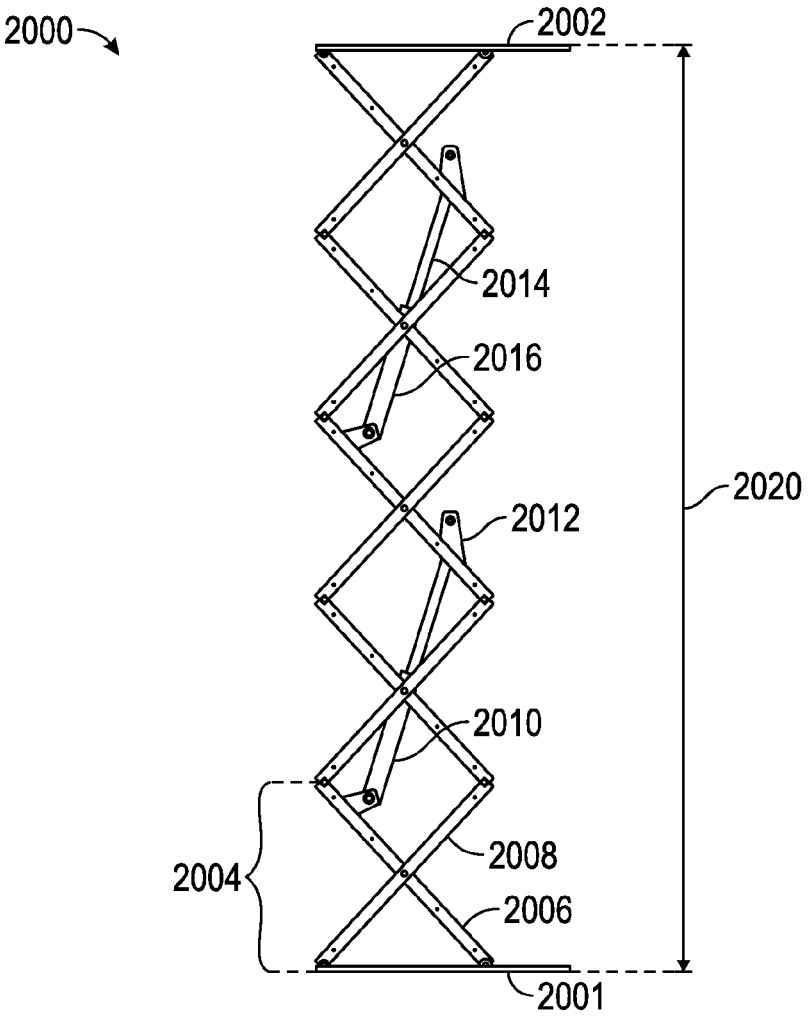
FIG. 20 is a schematic front elevation view of an exemplary scissor mast in the extended position, depicting exemplary hydraulic or pneumatic cylinders for use in extending and retracting the mast in accordance with various embodiments.

FIG. 20 is an exemplary front view of a scissor mast 2000 in the extended position, depicting exemplary hydraulic or pneumatic cylinders for use in extending and retracting the mast in accordance with various embodiments. In particular, the scissor mast 2000 includes a lower platform 2001, an upper platform 2002, and a plurality (e.g., five) of sections 2004 each comprising first and second cross bars 2006, 2008. One or more hydraulic, pneumatic, or otherwise actuable cylinders 2010 are connected to brackets 2012 to thereby cause extension and/or retraction of the mass in response to actuation of the cylinders or other actuating mechanism. In the illustrated embodiment, each cylinder compromises an internal piston (not shown) configured to slide a first segment 2014 along the inside of a second segment 2016 to thereby extend the mast to a height dimension 2020 in the range of 72 to 960 inches, and preferably about 415 inches.

Figure 21:
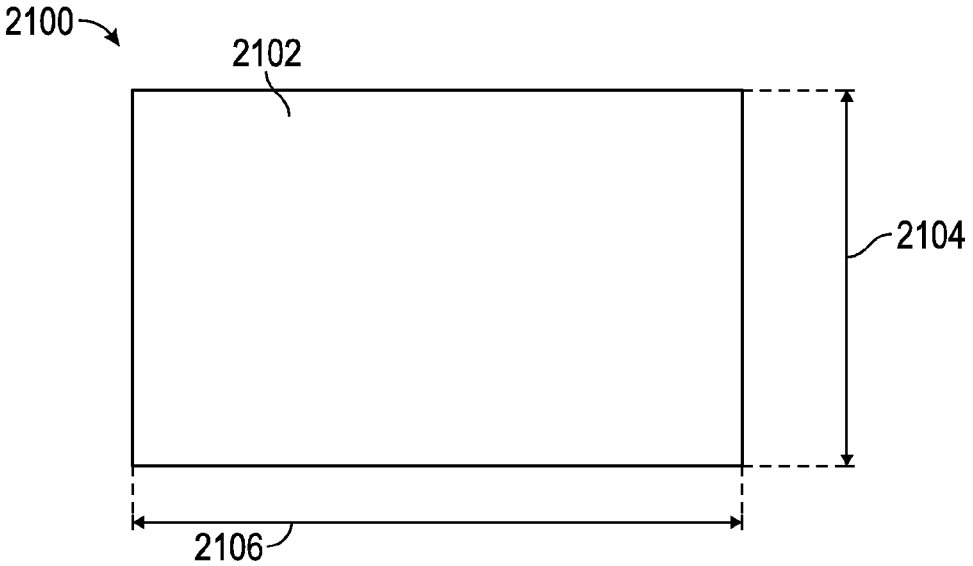
FIG. 21 is a schematic top view of the platform shown in FIG. 20 in accordance with various embodiments.

FIG. 21 is a schematic top view of the mast shown in FIG. 20, and depicts a top platform 2102 having a width dimension 2106 in the range of 60 to 1200 inches, and preferably about 103 inches, and a length dimension 2104 in the range of 24 to 144 inches, and preferably about 64 inches.

Figure 22:
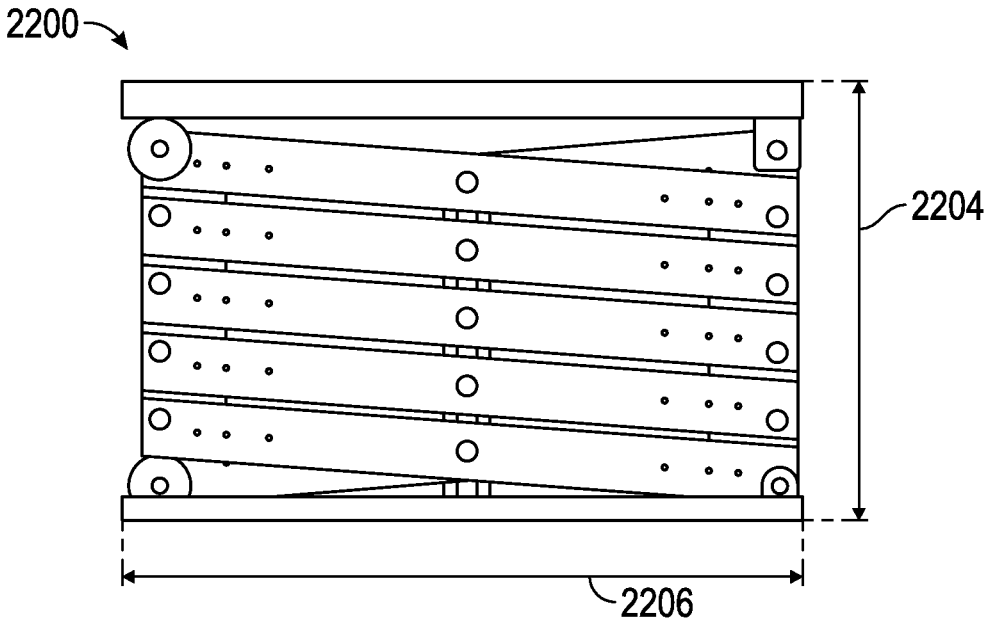
FIG. 22 is a schematic front elevation view of the scissor mast of FIG. 20, shown in the retracted position in accordance with various embodiments.

FIG. 22 is a schematic front elevation view of the scissor mast of FIG. 20, shown in the retracted position in accordance with various embodiments. In particular, a foldable mast 2200 exhibits a width dimension 2206, and a height dimension 2204 in the range of 12 to 120 inches, and preferably about 44 inches.

Figure 23:
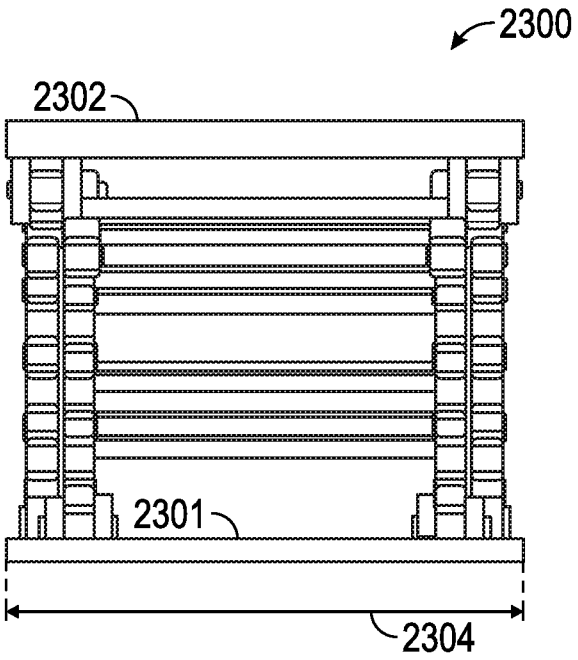
FIG. 23 is a side view of the scissor mast of FIG. 22 in accordance with various embodiments.

FIG. 23 is a side view of a scissor mast 2300 including a top platform 2302, and exhibiting a length dimension 2304 in the range of 12 to 120 inches, and preferably about 64 inches.

While the present invention has been described in the context of the foregoing embodiments, it will be appreciated that the invention is not so limited. For example, the foldable mast may include any configuration of members and/or actuators which allow the mast to extend and retract within the dimensional parameters described herein. Moreover, while the extendable mast has been described in the context of a mobile or portable system, the present invention also contemplates permanent or semi-permanent tower installations.

A mobile communications system is thus provided, including: a platform; a transmitter; and a foldable mast for supporting the transmitter above the platform.

In an embodiment, the platform includes a truck bed or a trailer bed.

In an embodiment, the transmitter comprises an antenna.

In an embodiment, the transmitter comprises a spherical array antenna.

In an embodiment, the foldable mast comprises at least one scissors section.

In an embodiment, the scissors section comprises a first cross bar pivotably connected to a second cross bar.

In an embodiment, the system further includes an actuator configured to urge a first end of the first cross bar away from a second end of the second cross bar, to thereby extend the mast upwardly.

In an embodiment, the actuator is further configured to urge the first end of the first cross bar toward the second end of the second cross bar, to thereby retract the mast downwardly.

In an embodiment, the actuator comprises a hydraulic cylinder.

In an embodiment, the system further includes a radio bay disposed on the platform and communicatively coupled to the transmitter.

In an embodiment, the transmitter comprises an antenna, and wherein the antenna is affixed to the foldable mast such that, when the foldable mast is in a retracted position, the combined height of the stacked antenna and mast is less than 156 inches from the ground.

In an embodiment, the foldable mast comprises a plurality of scissors sections which cooperate to selectively extend the antenna to a height in the range of at least 360 inches above ground.

In an embodiment, the system further includes respective front and rear outriggers extending from the platform; and a plurality of guys connecting the antenna to the outriggers.

In an embodiment, the system further includes a power generator and an air conditioner supported by the platform.

In an embodiment, the mast includes five scissor sections exhibiting a height dimension in the retracted position in the range of 36 to 48 inches above the platform, and further wherein the antenna exhibits a height dimension in the range of about 60 to about 80 inches.

In an embodiment, the mast in the retracted position exhibits a width dimension in the range of 96 to 108 inches, and a length dimension in the range of 48 to 72 inches.

A cell tower is also provided. The cell tower includes an extendable and retractable mast for supporting an antenna, wherein the mast comprises a scissor configuration.

A self-contained, mobile cellular system mounted on a vehicle bed is also provided. The system includes: an extendable scissors mast having a plurality of sections, each section comprising a first cross bar pivotably connected to a second cross bar, the mast further including an actuator configured to selectively extend and retract the mast; and an antenna fixed atop the mast.

In an embodiment, the mast in a retracted position is confined to an envelope having a height in the range of 24 to 60 inches, a length in the range of 48 to 72 inches, and a width in the range of 72 to 120 inches.

In an embodiment, the antenna exhibits a height dimension in the range of 60 to 90 inches.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A mobile communications system, comprising:

a platform mounted to a mobile trailer;

a foldable mast assembly mounted to the platform and configured to operate between an extended position and a retracted position; and a transmitter mounted to the mast assembly in the retracted position.

2. The system of claim 1, wherein the platform comprises one of a truck bed and a trailer bed.

3. The system of claim 1, wherein the transmitter comprises an antenna.

4. The system of claim 1, wherein the transmitter comprises a spherical array antenna.

5. The system of claim 1, wherein the foldable mast comprises at least one scissors section.

6. The system of claim 5, wherein the scissors section comprises a first cross bar pivotably connected to a second cross bar.

7. The system of claim 6, further comprising an actuator configured to urge a first end of the first cross bar away from a second end of the second cross bar, to thereby extend the mast upwardly.

8. The system of claim 7, wherein the actuator is further configured to urge the first end of the first cross bar toward the second end of the second cross bar, to thereby retract the mast downwardly.

9. The system of claim 7, wherein the actuator comprises a hydraulic cylinder.

10. The system of claim 7, further comprising a radio bay disposed on the platform and communicatively coupled to the transmitter.

11. The system of claim 10, wherein the transmitter comprises an antenna, and wherein the antenna is affixed to the foldable mast such that, when the foldable mast is in a retracted position, the combined height of the stacked antenna and mast is less than 156 inches from the ground.

12. The system of claim 11, wherein the foldable mast comprises a plurality of scissors sections which cooperate to selectively extend the antenna to a height in the range of at least 360 inches above ground.

13. The system of claim 12, further comprising:

front and rear outriggers extending from the platform; and a plurality of guys connecting the antenna to the outriggers.

14. The system of claim 13, further comprising a power generator and an air conditioner supported by the platform.

15. The system of claim 13, wherein the mast comprises five scissor sections exhibiting a height dimension in the retracted position in the range of 36 to 48 inches above the platform, and further wherein the antenna exhibits a height dimension in the range of about 60 to about 80 inches.

16. The system of claim 15, wherein the mast in the retracted position exhibits a width dimension in the range of 96 to 108 inches, and a length dimension in the range of 48 to 72 inches.

17. A cell tower including an extendable and retractable mast for supporting an antenna, wherein the mast comprises a scissor configuration.

18. A self-contained, mobile cellular system mounted on a vehicle bed, comprising:

an extendable scissors mast having a plurality of sections, each section comprising a first cross bar pivotably connected to a second cross bar, the mast further including an actuator configured to selectively extend and retract the mast; and an antenna fixed atop the mast.

19. The system of claim 18, wherein the mast in a retracted position is confined to an envelope having a height in the range of 24 to 60 inches, a length in the range of 48 to 72 inches, and a width in the range of 72 to 120 inches.

20. The system of claim 19, wherein the antenna exhibits a height dimension in the range of 60 to 90 inches.

* * * * *